United States Patent [19]

Matsui et al.

[11] 4,434,631

[45] Mar. 6, 1984

[54] APPARATUS FOR TREATING PILE ARTICLES

[75] Inventors: Masao Matsui, Takatsuki; Kazuo Okamoto; Takao Osagawa, both of Osaka, all of Japan

[73] Assignees: Kanebo, Ltd., Tokyo; Kanebo Synthetic Fibers Ltd., Osaka, both of Japan

[21] Appl. No.: 342,557

[22] Filed: Jan. 25, 1982

[30] Foreign Application Priority Data

Jan. 26, 1981 [JP] Japan ..... 56-10364

[51] Int. Cl.[3] ..... D06B 1/10

[52] U.S. Cl. ..... 68/171; 26/2 R; 118/52; 118/416; 118/421

[58] Field of Search ..... 68/148, 149, 157, 162, 68/171, 200; 118/52, 416, 421; 427/240; 69/32; 26/2 R; 28/159

[56] References Cited

U.S. PATENT DOCUMENTS

| | | | |
|---|---|---|---|
| 750,601 | 1/1904 | Cleff | 68/148 |
| 3,112,633 | 12/1963 | Wilkinson, Jr. | 68/148 |
| 3,847,116 | 11/1974 | Prichard | 118/52 |

*Primary Examiner*—Philip R. Coe

*Attorney, Agent, or Firm*—Flynn, Thiel, Boutell & Tanis

[57] ABSTRACT

An apparatus for producing pile articles having complicated and high color tone and structure, such as artificial furs, writing brushes, brushes, etc. comprises a rotating body to which a pile article is fixed and which is rotated together with the pile article whereby centrifugal force is applied to the piles, a rotary container wherein at least one treating liquid for the above described piles is retained and at least one inner interface of the treating liquid is formed owing to the centrifugal force caused by the rotation to contact the piles with the treating liquid, and a feeding portion from which the treating liquid is fed into the rotary container and a discharging portion from which the treating liquid is discharged.

6 Claims, 4 Drawing Figures

APPARATUS FOR TREATING PILE ARTICLES

BACKGROUND OF THE INVENTION

The present invention relates to an apparatus for treating pile articles.

Fibrous products having piles, such as cut piles or loop piles, have various unique appearances and feels and are broadly used. For improving the appearances, feels and the like, a variety of processing methods have been carried out and proposed.

One object of production of these pile articles is to obtain fur-like articles. However, as is well-known, natural furs have very complicated, delicate and high colors and structures and the production of pile articles that closely simulate natural furs has been substantially impossible. For example, most natural furs have precise piles having different colors at the root portion, middle portion and top portion and it has been very difficult and has substantially not been practically conducted to produce such pile articles.

Similarly, in natural furs, the fineness of the root portion, middle portion and top portion of the piles is different. A fairly large number of processes for producing furs having such piles have been proposed but there has been yet no process having satisfactory precision and practicability.

Therefore, most fur-like articles obtained in prior processes do not have such complicated and high color tone and structure in the piles as in natural furs, but are only low quality imitations.

In writing brushes, brushes and the like, piles wherein the top is made fine, are required in view of the writing ability, feeling, touch and the like and natural hairs of animals have been used. A large number of proposals for artificially producing piles of the writing brushes, brushes and the like have been made but these proposals are not yet satisfactory in view of the precision.

SUMMARY OF THE INVENTION

An object of the present invention is to provide a novel apparatus for producing pile articles having complicated and high color tones and structures comparable with natural furs.

Another object of the present invention is to provide a novel apparatus capable of producing pile articles having high design and feel.

A further object of the present invention is to provide a novel apparatus capable of producing writing brushes and brushes having piles which have the precise form equal to or higher than animal hairs.

That is, the present invention is to provide an apparatus which can dye or decolor piles whereby the hue and lightness are varied in high precision in the length direction of the piles and can vary the fineness of the pile fiber in high precision in the length direction of the piles.

Heretofore, in order to give hues that vary in the length direction of the piles, a dyestuff or a decoloring composition has been applied on the surface (the top portion of the piles) but this process is not satisfactory in precision and it is difficult to obtain a complicated hue.

One of the most important problems that occurs when the coloration and the fineness (diameter) are varied in the length direction of the piles is to maintain the piles in the raised state and to subject the piles to any required process with high precision. The inventors have made diligent study with respect to this point and found that the colored state and the fineness of the piles can be freely varied by keeping the piles in the raised state owing to centrifugal force, forming a liquid surface (interface) of a treating liquid (for example, dyeing solution, decoloring solution, solvent, decomposing solution, etc.) against the raised piles and adjusting the contacting state of the liquid surface (interface) and the piles. The inventors already proposed this discovery in Japanese Patent Application No. 91,407/79. The present invention is to provide an apparatus which can carry out the above described process with higher precision and which has a relatively simple structure.

The apparatus of the present invention comprises a rotating body to which a pile article is fixed and which is rotated together with the pile article whereby centrifugal force is applied to the piles, a rotary container wherein at least one treating liquid for the above described piles is retained and at least one inner interface of the treating liquid is formed owing to centrifugal force caused by the rotation to contact the piles with the treating liquid, and a feeding portion from which the treating liquid is fed into the rotary container and a discharging portion from which the treating solution is discharged.

DESCRIPTION OF THE PREFERRED EMBODIMENTS

The present invention will be explained with reference to the drawings hereinafter.

Figure 1:
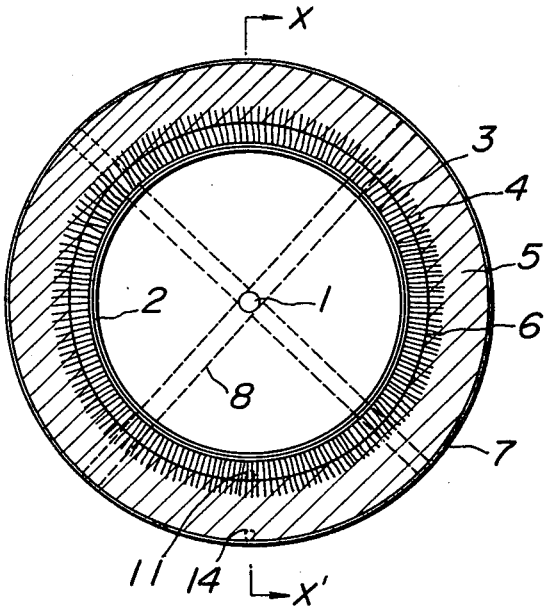
FIG. 1 is a transverse cross-sectional view of an apparatus for producing a pile article showing one embodiment for carrying out the present invention.
Figure 2:
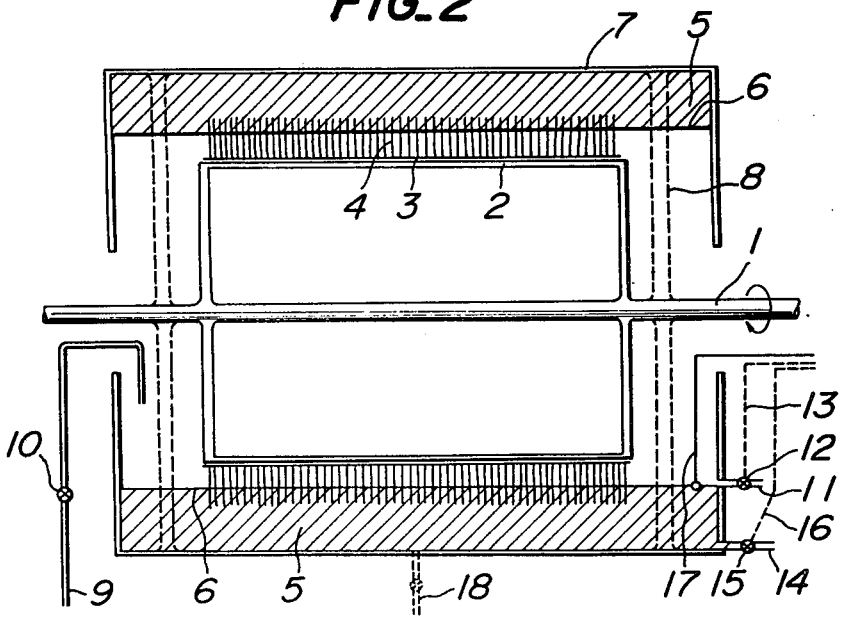
FIG. 2 is a vertical cross-sectional view taken along the line X—X' in FIG. 1.

FIG. 1 and FIG. 2 are the drawings concretely illustrating an example of the present invention. In FIG. 1 and FIG. 2, a rotating body 2 is connected to a rotary axle 1 and is rotated at a high speed. To the rotating body 2 is fixed a pile fabric composed of a substrate fabric 3 and piles 4 and the pile fabric is rotated together with the rotating body and the piles are straightly raised outwardly by the centrifugal force. An outer container 7 is connected to the rotary axle 1 through supporter 8 and is similarly rotated at a high speed. In the container 7 is retained a treating liquid 5 for the piles and an interface 6 is formed in the inside of the container by the centrifugal force caused by the rotation.

In the apparatus and the driving process shown in FIG. 1 and FIG. 2, by treating the desired position of the piles by means of a solvent, a decomposing composition, a dyeing solution, a decoloring solution and the like, for example, the top end portion of the piles can be made fine by dissolving or decomposing said portion or can be dyed or decolored. The portion of the piles to be treated is determined by the position of the interface 6. Therefore, in order to treat the desired portion of the piles, it is merely necessary to adjust the position of the interface 6. The position of the interface 6 may be kept at a constant position or gradually moved. When the position of the interface 6 is constant, the fineness of the piles is suddenly varied or the piles are cut at the predetermined length by the dissolving or decomposing treatment or the color tone is suddenly varied by the dyeing or decoloring treatment.

If the interface 6 is gradually moved, the piles wherein the fineness is gradually varied by the dissolving or decomposing treatment, can be obtained, or the piles wherein the color tone is gradually varied (gradated) can be obtained by the dyeing or decoloring treatment.

By keeping the position of the interface 6 at the predetermined position or moving said position following to the predetermined program, the pile articles in which the piles have the desired variation in the shape (variation of fineness), and color tone (lightness, chroma, hue and the like), can be freely produced. Thus, in such an apparatus and the driving process thereof, it is necessary to control the position of the interface 6 correctly and in high precision.

In the apparatus of the present invention, the supply and/or the discharge of the treating liquid is preferably carried out at end surfaces of the rotary container. The term "end surface" of the rotary container used herein means the surface viewed from the direction of the rotary axis. In FIG. 2, the treating liquid 5 is fed into the rotary container through the feeding pipe 9 and a control valve 10 from the left axial end surface. On the other hand, the treating liquid 5 is discharged from the discharging portions 11 and 14 provided at the right axial end surface of the container 7. 12 and 15 are control valves and for example, by making these valves to be electric magnetic valves, a remote control is feasible from the outside through control circuits 13 and 16. The connection of the circuits 13 and 16 to the outside may be effected by providing slip rings on the axle 1.

The control of the position of the interface 6 is effected by the supply and/or discharge of the treating liquid 5. That is, when the treating liquid is fed, the interface 6 elevates (approaches the axle 1) and when said liquid is discharged, the interface 6 descends (retreats from the axle 1). The first method for controlling the position of the interface 6 comprises feeding or discharging the treating liquid by operating the control valves 10 and 15. In particular, by detecting the position of the interface with a liquid level detector 17 and effecting the above described control based on the signal (by feedback), it is possible to control the interface in high precision, to constantly keep the interface or vary the interface continuously or stepwisely. As the liquid level detector, the devices which derive an electrical signal representing the position of the interface 6, such as a float type, a radiation type, an electric resistance type, an electrostatic capacitance type, an ultrasonic type, an optical type (laser light, etc.) and the like, are convenient.

The second method for controlling the interface 6 is to use an outlet provided at the end surface of the rotary container 7. For example, when the valve 15 is closed and the valve 12 is opened in FIG. 2, even if the treating liquid is fed by means of the valve 10, the interface 6 is not elevated over the position of the outlet 11 (provided that the fed amount must not be larger than the discharged amount). That is, the interface is kept at a constant level by the outlet 11. If a plurality of similar outlets are provided by varying the position (distance from the axle 1), the interface 6 can be kept at a plurality of positions. For example, if a large number of outlets are provided at intervals of 1 mm, the position of the interface can be set and held at intervals of 1 mm and if the position of the interface is varied following a predetermined program, the position of the interface can be stepwisely controlled. When an outlet 18 is provided at an outer circumferential surface of the container 7 as shown in FIG. 2, the treating liquid 5 can be discharged but the control of the position of the interface as in the above described second method is infeasible (the first method is feasible).

Furthermore, the treating liquid 5 may be fed into the rotary container 7, for example, by making the axle 1 in the form of a hollow tube and providing a branch tube in an intermediate portion of the axle and feeding said liquid from the terminal end but in this case a complicated device is needed to connect the feeding portion to the rotary axle which is rotated at a high speed. On the contrary, the supply of the treating liquid from the end surface as in FIG. 2 is very simple and economic, causes few troubles and has great merits.

Figure 3:
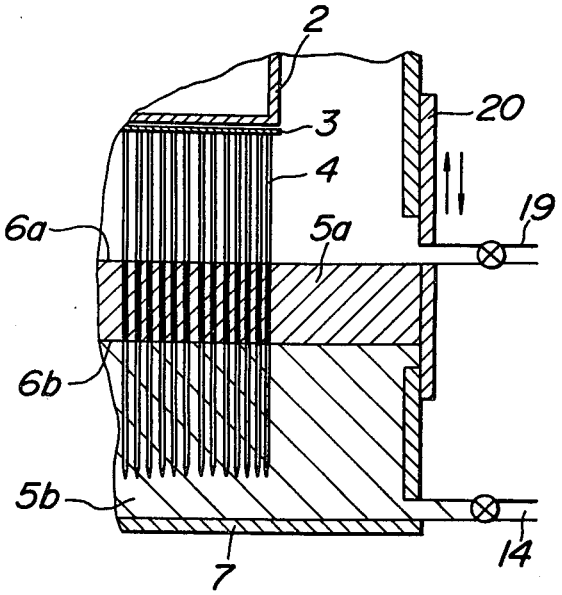
FIGS. 3 and 4 are partial cross-sectional views showing other embodiments of the present invention respectively.

FIG. 3 is a partial view showing another example of the present invention. In FIG. 3, as the treating liquid use is made of a liquid (for example, dyeing solution) **5*a* having activity to the piles 4 and an inactive liquid 5*b*. The liquids 5*a* and 5*b* are not miscible with each other and the density of the inactive liquid 5*b* is higher than that of the active liquid 5*a*, so that the active liquid 5*a* forms an inner layer and the inactive liquid 5*b* forms an outer layer and these liquids form a two layer structure. The piles 4 are treated (dyed) only at the portion (in FIG. 3, black portion) contacted with the active liquid 5*a*. The position of the inner interface 6*a* of the active liquid is determined by the outlet 19 and the outer interface 6*b* is controlled by the adjustment of an amount of the inactive liquid 5*b*, for example by opening or closing the outlet 14. By using two kinds of solutions as shown in FIG. 3, it is possible to treat the desired portion of the piles along the desired length or to treat the piles while moving the interfaces 6*a* and 6*b*. In FIG. 3, the outlet 19 is provided at a plate 20 capable of being moved as shown by the arrows and the treatment may be effected by using this plate by keeping the interface 6*a* at the predetermined position or moving the interface 6*a* by moving the plate 20**.

The apparatuses in FIG. 1 to FIG. 4 show the examples of the present invention and do not limit the present invention. A large number of modifications can be made following to the present invention.

Figure 4:
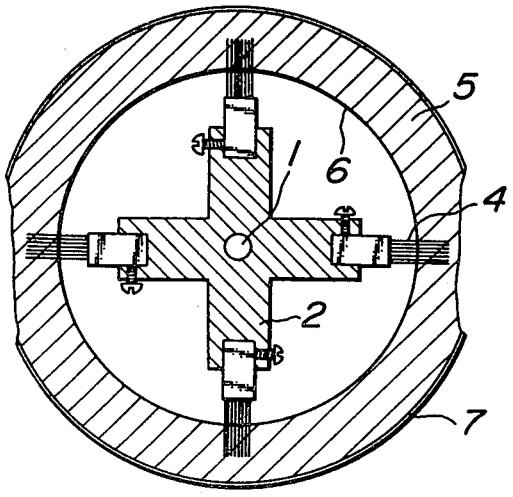

The rotating body 2 is a cylinder which is concentric with the axle but may be any shape, if necessary. For example, by using a cone (frusto-cone), a cylinder which is eccentric to the axle 1, corrugated and any other uneven shape, the articles wherein the shape, length or color tone of the piles are varied depending upon the place, are obtained. For effecting the treatment of writing brushes or brushes, a fixing member having a shape suitable for fixing the writing brush or brush may be provided. This embodiment is shown in FIG. 4.

The rotary container 7 may be a cylinder, cone or other desired shape. It is preferable that the center of gravity coincides with the central axis so that the rotary container 7 and the rotating body 2 do not vibrate during operation.

The rotary axis of the rotating body and the axis of the rotary container may be common or separate. Similarly, the rotating speeds (angle velocities) of the rotating body and the rotary container may be equal or more or less different. In general, it is preferable that the axis is common and the speed is equal.

Three or more treating liquids may be used together. If an inactive treating liquid having a lower density than an active liquid is used, the centrifugal force of the inactive liquid is applied to the active liquid and the treatment under pressure may be effected. Thus, even if a pressure is not particularly applied, the treatment under pressure, for example, the dyeing under pressure (in aqueous system, 135° C., about 3 atm.) can be carried out in an open system. Of course, in this case, the inactive liquid serves the sealing function. For example, if the weight of the inner liquid per 1 $cm^2$ is 1 g and the centrifugal acceleration is 1,000 G, a pressure of about 1 atm. can be sealed.

As mentioned above, the present invention can be applied to a variety of produced articles or semiprocessed articles (parts), which have piles and can be applied to dyeing, decoloring, cutting, variation of fineness, swelling, dissolution, decomposition, adsorption, shrinking, crimp-developing, heat-treatment and other various treatments of the piles.

The centrifugal force applied in the present invention must have enough power to raise the piles and form a cylindrical liquid surface (interface) in the treating liquid and is generally more than 3 times (3 G) of the gravity acceleration G, in many cases more than 5 times (5 G), preferably more than 10 times (10 G) and particularly more than 30 times (30 G). As the acceleration due to the centrifugal force is larger (particularly more than 100 G), the raising ability of the piles is higher but the centrifugal force is limited to less than 10,000 G in practice in view of the mechanical strength. For example, when the radius is 1 m and the rotating speed is 1 rotation per 1 second, the centrifugal force is about 4 G but the raising ability of the piles and the cylinder-forming ability of the liquid surface of the treating liquid are somewhat low. When the rotating speed is 10 rotations per 1 second, the centrifugal acceleration is about 400 G and is satisfactory.

The direction of the rotary axle 1 may be horizontal, perpendicular or any other angle. Furthermore, in order to control the temperature of the treating liquid, it is possible to provide a heating or cooling apparatus or a temperature detecting device. Furthermore, the apparatus may be covered with a proper case for heating, insulating, protecting and the like. A device for recovering drainage may be provided. The state (depth) where the treating liquid is contacted with the piles may be varied in sine, linear, quadratic or any other time function.

The rotary angle velocity of the holding portion of the piles and the treating liquid may be equal or more or less different. The equal case is advantageous, because the rotary axis and the driving system can be used together. When the rotary angle velocity is different, the treating liquid is stirred and the more uniform treatment is feasible. When the velocity difference is too high (for example, more than 2 rotation/sec.), the raising of the piles is disturbed and such a case is not preferable. Furthermore, in order to keep the uniformity of the treating liquid, it is possible to provide a pump in the system of the treating liquid and circulate the liquid.

By using the apparatus of the present invention, it is possible to treat the fabrics or sheet materials having piles or piles of writing brushes or brushes in very high precision and very complicatedly and delicately. Accordingly, the products having the same high quality, appearance and performance as in natural furs and animal hairs can be obtained. In addition, the apparatus of the present invention can provide the pile articles, and writing brushes having high design, color, appearance, feeling and writing ability, which are not possessed by natural furs and animal hairs.

What is claimed is:

1. An apparatus for treating a pile article or articles, comprising:

an elongated, rotatable, hollow container, an elongated, rotatable body substantially coaxially disposed inside said container, said container and said body being mounted for rotation at substantially the same speed about a common, longitudinally extending, axis of rotation, said container having a longitudinally extending inner wall surface and said body having longitudinally extending outer wall surface means opposed to and spaced radially inwardly from said inner wall surface of said container, said inner wall surface and said outer wall surface means defining a treatment zone therebetween, the pile article or articles being fixed on said outer wall surface means of said body so that rotation of said body applies centrifugal force on the piles so that they extend radially outwardly in said treatment zone, said container retaining at least one treating liquid in said treatment zone so that rotation of said container applies centrifugal force on said treating liquid to form same into at least one layer on said inner wall surface in said treatment zone and with at least one interface of said treating liquid contacting the piles on the pile article or articles; feeding means for feeding treating liquid into said container and discharging means for discharging treating liquid from said container.

2. The apparatus as claimed in claim 1, wherein said apparatus is provided with a detecting device for detecting the position of said interface of the treating liquid, and a controlling system for controlling said feeding means and/or said discharging means in response to a signal from said detecting device, whereby the position of said interface of the treating liquid is controlled.

3. The apparatus as claimed in claim 1, wherein said discharging means comprises a plurality of outlets for the treating liquid provided at positions located at various different radial distances from the axis of rotation of said container.

4. The apparatus as claimed in claim 1, wherein said discharging means comprises a radially movable outlet which can be moved radially to positions located at various different radial distances from the axis of rotation of said container.

5. An apparatus for treating a pile article, comprising:

an elongated, rotatable, cylindrical container having radially inwardly extending end walls at the opposite axial ends thereof, an elongated, rotatable, cylindrical body substantially coaxially disposed inside said container and between said end walls, said container and said body being mounted for rotation at substantially the same speed about a common, longitudinally extending, axis of rotation, said container having a cylindrical inner wall surface and said body having a cylindrical outer wall surface opposed to and spaced radially inwardly from said inner wall surface of said container, said inner wall surface and said outer wall surface defining an annular treatment zone therebetween, the pile article being fixed on said outer wall surface of said body so that rotation of said body applies centrifugal force on the piles so that they extend radially outwardly in said treatment zone, said container retaining at least one treating liquid in said treatment zone so that rotation of said container applies centrifugal force on said treating liquid to form same into at least one annular layer on said inner wall surface in said treatment zone and with at least one interface of said treating liquid contacting the piles on the pile article; means in one of said axial end walls for feeding treating liquid into said container and means in the other of said axial end walls for discharging treating liquid from said container.

6. An apparatus for treating pile articles, comprising: an elongated, rotatable, cylindrical container having radially inwardly extending end walls at the opposite axial ends thereof, an elongated, rotatable body substantially coaxially disposed inside said container, said container and said body being mounted for rotation at substantially the same speed about a common, longitudinally extending, axis of rotation, said container having a cylindrical inner wall surface and said body having circumferentially spaced-apart, longitudinally extending outer wall surface parts opposed to and spaced radially inwardly from said inner wall surface of said container, said inner wall surface and said outer wall surface parts defining a treatment zone therebetween, the pile articles being fixed on said outer wall surface parts of said body so that rotation of said body applies centrifugal force on the piles so that they extend radially outwardly in said treatment zone, said container retaining at least one treating liquid in said treatment zone so that rotation of said container applies centrifugal force on said treating liquid to form same into at least one annular layer on said inner wall surface in said treatment zone and with at least one interface of said treating liquid contacting the piles on the pile articles; means in one of said axial end walls for feeding treating liquid into said container and means in the other of said axial end walls for discharging treating liquid from said container.

* * * * *